United States Patent [19]

Larsson

[11] 4,388,054

[45] Jun. 14, 1983

[54] METHOD FOR MANUFACTURING ELONGATED BODIES BY EXTRUSION OF POWDER IN A CAPSULE

[75] Inventor: Hans-Gunnar Larsson, Västerås, Sweden

[73] Assignee: ASEA Aktiebolag, Västerås, Sweden

[21] Appl. No.: 255,732

[22] Filed: Apr. 20, 1981

[30] Foreign Application Priority Data

Apr. 25, 1980 [SE] Sweden ..... 8003139

[51] Int. Cl.[3] ..... B22F 5/00; F16H 7/00

[52] U.S. Cl. ..... 419/32; 419/28; 419/48; 419/49

[58] Field of Search ..... 75/214, 226, 200; 29/420.5, 420; 419/50, 43, 53, 34, 32, 67, 69, 28, 48, 49

[56] References Cited

U.S. PATENT DOCUMENTS 3,645,728 2/1972 Hrinevich, Jr. ..... 75/214
3,723,109 3/1973 Cairns et al. ..... 75/214
3,834,002 9/1974 Sissons et al. ..... 29/420
3,871,200 3/1975 Onoda et al. ..... 29/420.5
3,892,030 7/1975 De Pierre et al. ..... 29/420

*Primary Examiner*—Lowell A. Larson
*Assistant Examiner*—V. K. Rising
*Attorney, Agent, or Firm*—Watson, Cole, Grindle & Watson

[57] ABSTRACT

A method for manufacturing elongated dense bodies of metals or metal alloys by extrusion of a powder charge enclosed in a metal capsule. A closed, powder-filled capsule is heated to a temperature necessary for bonding the charge under pressure, and the capsule is then inserted in a pressure chamber and surrounded by a layer of a solid, readily deformable material, such as talcum powder or pyrophyllite. A piston is inserted into the pressure chamber and subjects the capsule and the surrounding material to a pressure such that the capsule and the surrounding material are pressed out together through an opening in a die. Tubes can also be extruded, with the deformable packing material filling the tube bore.

11 Claims, 3 Drawing Figures

METHOD FOR MANUFACTURING ELONGATED BODIES BY EXTRUSION OF POWDER IN A CAPSULE

TECHNICAL FIELD

The present invention relates to a method for manufacturing an elongated dense body of a metal or metal alloy by extrusion. The starting material is a metallic powder which is enclosed in a metal capsule. The term elongated body covers both a solid rod, e.g., one having such a geometry and dimensions that it can be further machined by rolling, or a tube billet. The extruded product may be given a very high density. Full theoretical density may be attained directly by the extrusion or by a subsequent hot working.

The advantages of starting from a powder are particularly great when manufacturing products of high-alloy materials. This eliminates segregations, voids, uneven composition and the unfavourable coarse grain structure obtained in ingots manufactured in accordance with conventional metallurgical methods. These faults and this unfavourable structure arise because of the slow cooling employed in the prior art methods. The segregations and the voids must be removed, which results in a low material gain and in the finished product becoming more expensive. By producing the starting material for powder compaction by breaking up a jet of molten metal with a gas stream into small metal droplets, the droplets solidify almost instantaneously. This leads to a powder having a favourable, fine structure. This fine structure may be maintained during the subsequent consolidation of the thus-produced powder into a solid body.

BACKGROUND ART

Extrusion of powder in capsules has hitherto been hampered because of a number of problems that have been difficult to solve. Among other things, there have been considerable problems with the methods used so far due to a folding of the capsule sheet material. In an article entitled "The Consolidation of Metal Powder by Hot Working within Sheaths" in *Powder Metallurgy* 1958, Nos. 1, 2, pages 94–103, I. Williams describes different methods of manufacturing products starting from a powder. In one section extrusion is discussed and folding of the capsule sheet is stated to be a serious restriction to the method. To reduce the risk of folding, proposals have been made to isostatically press the capsule, prior to the extrusion, under cold conditions so as to obtain a density of at least 80% of the theoretical density. Such a compression is possible for materials which give a soft powder during granulation, but not for materials which give a hard, spherical powder. A capsule filled with high-speed tool steel powder cannot be compressed so as to obtain sufficient density.

The invention makes it possible to extrude a powder-filled capsule without prepressing the capsule in the cold state and with a good result, even though the density of powder within the capsule is that which is obtainable by vibrating the capsule while filling it. The invention thus makes possible the extrusion of hard, spherical powders that cannot be densified by cold isostatic pressing. The density obtainable through vibration of a spherical powder is normally between 67 and 72% of the theoretical density.

DISCLOSURE OF INVENTION

According to the invention, a capsule filled with metal powder is heated to a temperature necessary for bonding of the metal powder grains at the extrusion pressure to be used, the capsule then being inserted into a pressure chamber and surrounded by a thermally insulating layer of a readily deformable powder which is thermally stable at the pressing temperature and has powder grains having a layer structure so that they easily slide one against another. Talcum powder or pyrophyllite powder are examples of such powder materials.

When the capsule and the surrounding material is subjected to a sufficient pressure, the capsule with its contents and the surrounding material are pressed out through an opening in a die at one end of the pressure chamber. The talcum powder, or the other suitable material surrounding the capsule, substantially prevents folding of the capsule sheet during the pressing. In addition, the heat-insulating property of the material results in the capsule material not being cooled to any substantial extent through heat transfer to the pressure chamber wall. This means that the capsule need not be heated to an overtemperature in view of the low anticipated heat loss. This limitation on the temperature requirement reduces the risk of undesired grain growth. It is desirable that no capsule residues remain in the pressure chamber and the die. By using a sufficient volume of surrounding powder material between the upstream end of the capsule and the piston, which induces the pressure rise in the pressure chamber, it is an easy matter to ensure that the capsule will be expelled completely from the chamber. Operating in this way means that the die need not be replaced between each pressing operation.

The density obtained is dependent not only on the temperature used, but also on the degree of area reduction occasioned during the extrusion. The density increases with the degree of area reduction and may approach the theoretical density when this degree is large. When a considerable further area reduction is to be effected after the extrusion (e.g., by rolling or forging), it may be sufficient to employ only a small area reduction during the extrusion. During the subsequent working, the full, desired final density can then be obtained. It is also possible to achieve the full theoretical density using only a small area reduction if the capsule filled with powder is subjected to a very high pressure in the pressure chamber during a first stage of the extrusion process. This can easily be achieved in practice by closing off the die opening during this first stage and thereafter exposing the die opening and pressing out the capsule with its surrounding powder at a considerably lower pressure. A pre-compaction of the capsule and its powder charge may be obtained by delaying the start of the extrusion in several different ways. For example, a rupture disk may be placed between the die and the die support, the strength of the said disk being chosen so that it bursts when the desired precompaction pressure has been attained to open the die and allow the extrusion to start. It is also possible to construct the capsule with an end wall that has such a strength that this end wall acts as a rupture disk and provides such resistance during the initial stage of the extrusion that the desired precompaction pressure is attained. Alternatively, a displaceable plug may be used to close the die opening, which plug is removed when the precompaction has been performed. The reduction should be greater than 2:1, preferably greater than 6:1. In those cases where the capsule and its powder charge is pressed in two stages, it should be subjected to an axial pressure exceeding 2 kilobar, preferably exceeding 4 kilobar, in the first stage when the die opening is sealed.

Talcum powder is a suitable surrounding material for the pressing. It is both heat-insulating and deformable in the required manner. The fact that it is easily available and cheap is a further significant advantage. Filling of the gap between the capsule and the pressure chamber wall may be facilitated by a suitable grain graduation of the talcum powder used. The extrusion properties may be improved by mixing a lubricating medium into the talcum powder, for example, polytetrafluoroethylene, boron nitride, graphite or molybdenum disulfide. The extrusion can also be facilitated by coating the interior surface of the pressure chamber with a friction-reducing substance such as polytetrafluoroethylene. In view of the requirement to surround the capsule with talcum powder, the gap between the capsule and the surrounding wall of the pressure chamber should have a certain minimum size.

Furthermore, the layer of talcum powder must have a certain thickness in view of the heat insulation requirement and in view of the fact that extrusion of the capsule must occur. A thickness of the layer in the pressure chamber of 10–40 mm is considered suitable. To reduce the force loss which can occur during an extrusion, it may be suitable to use a press in which the cylinder of the pressure chamber is axially movable with respect to the die whereby during the extrusion, the pressure chamber is displaced axially with respect to the die because of the friction generated between the talcum powder and the pressure chamber wall when the press piston is inserted into the other end of the pressure chamber.

It is also possible to extrude a tube billet by the method according to the invention. In this case a tubular capsule is used and the bore in the capsule is filled with talcum powder or a similar easily deformable material, preferably of the same kind as that which is to be used to surround the billet. A prepressed rod of talcum can, for example, be inserted into the bore of the tube billet. It is also possible to use a fixed mandrel within the bore with a layer of talcum powder between the mandrel and the wall of the capsule defining the bore. This arrangement provides advantages when extruding a tubular product having a small bore. It is also possible to extrude products having several parallel channels by forming the billet with several parallel holes. The billet may be built up of several different materials. Thus, for example, a tube billet may consist of an outer portion of a simple steel material and an inner portion of a stainless material. In certain cases it may be practical to leave the talcum powder or another material in the tube bore or in the channels if the extruded product has to be further processed after the initial extrusion.

BRIEF DESCRIPTION OF DRAWINGS

The invention will now be described, by way of example, in greater detail with reference to the accompanying drawings, in which.

BEST MODE OF CARRYING OUT THE INVENTION

Figure 1:
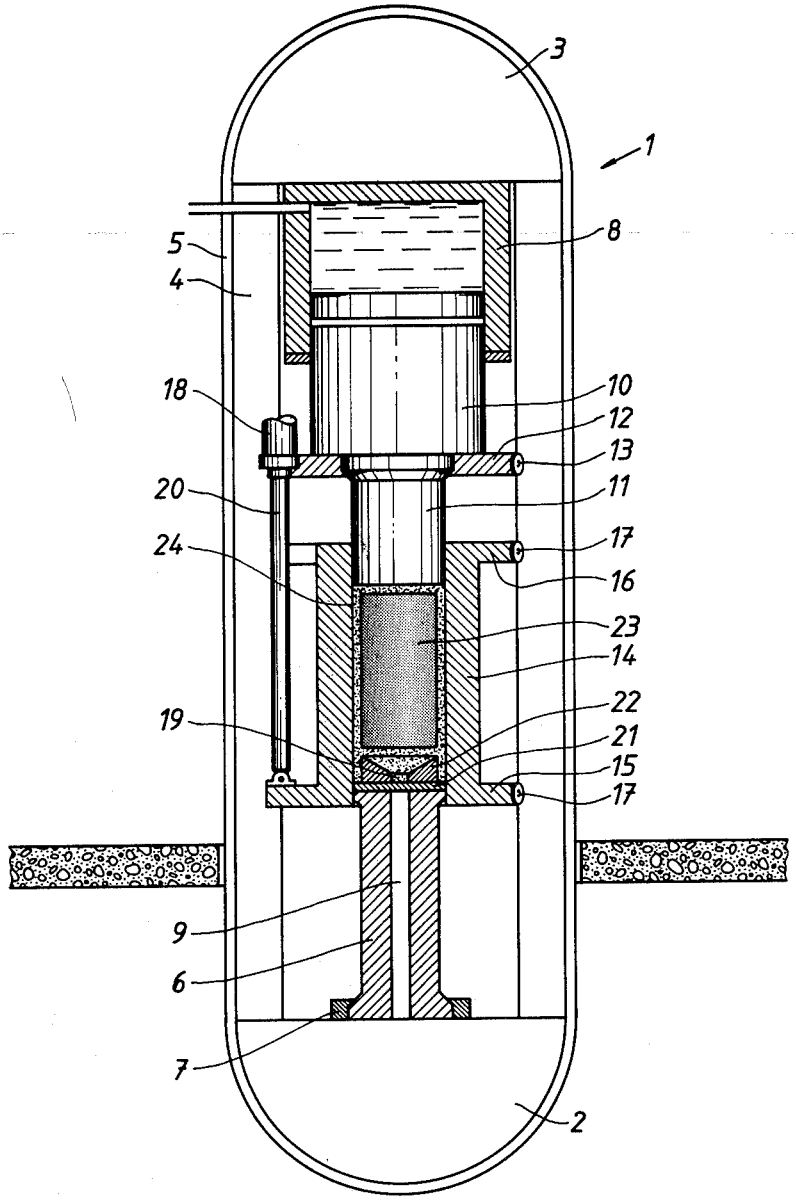
FIG. 1 is a partially sectioned schematic view of a press.

The press stand 1 illustrated in FIG. 1 is of the type which is built up of yokes 2 and 3, columns 4 and a force-absorbing sheath 5 fabricated from wound strip. A die support 6 with a channel 9 therein is attached to a lower yoke 2 by means of a holder ring 7. To the upper yoke 3 there is attached an operating cylinder 8 with a piston 10. A press piston 11 is joined to the piston 10 by a plate 12 which is provided with guide rolls 13 running against guides on the columns 4. For lifting the press piston 11 and moving the piston 10 back into the cylinder 8, operating cylinders (not shown) are provided. The press stand 1 includes a press cylinder 14 having end walls 15 and 16 each of which support guide rolls 17 running against guides on the columns 4.

The press cylinder 14 can be moved vertically by means of operating cylinders 18 which are attached to the upper portion of the press stand 1 and an appropriate number of piston rods 20 each of which is joined to the lower flange 15 of the press cylinder 14. A plate 21 rests on the die support 6, and a die 22 with an opening 19 therein rests on the plate 21. The press cylinder 14 contains a capsule 23 which is filled with a metal powder, the capsule 23 being surrounded by a readily deformable thermally-insulating powder material 24, which suitably consists of talcum powder.

Figure 2:
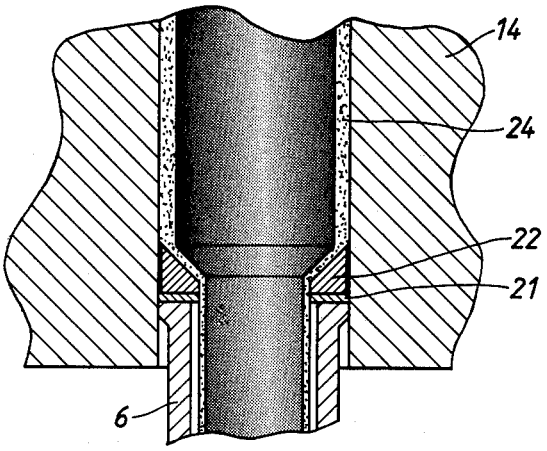
FIGS. 2 and 3 show, on an enlarged scale, the part of FIG. 1 around the extrusion die during extrusion of a solid billet and a tube billet, respectively.
Figure 3:
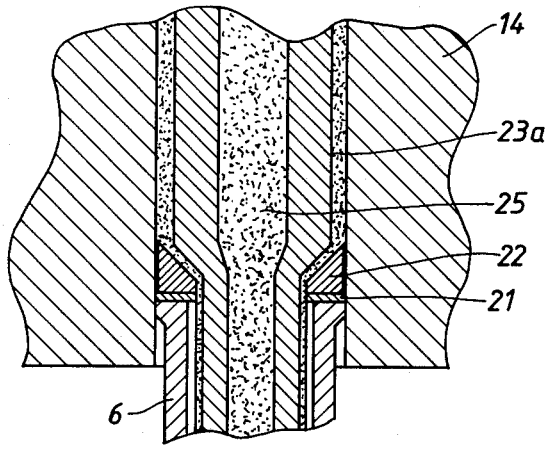

The plate 21, which acts as a rupture disk, is used in those cases where the capsule 23 has to be precompacted prior to extrusion. When a certain pressure has been generated in the cylinder 14, the plate 21 bursts and the extrusion automatically commences. The capsule material and the surrounding thermally-insulating readily deformable powder material 24 flow out together through the die 22, as shown in FIG. 2. When extruding a tubular capsule with a core 25 of a deformable material, a product with a core is obtained as shown in FIG. 3. The compressed talcum powder which surrounds the metal product and which forms the internal core during the extrusion of a tube, is brittle after the extrusion and may therefore be removed without difficulty.

What is claimed is:

1. A method of manufacturing an elongated, dense metallic body by extrusion of a powder charge enclosed in a metal capsule, which method comprises (a) heating the powder charge in its metal capsule to a temperature sufficient to cause bonding of the charge at the pressure applied in step (d) to achieve extrusion;

(b) inserting the capsule containing the heated powder charge into a pressure cylinder which has positioned at one end thereof a die having an opening therethrough;

(c) surrounding the capsule in the pressure cylinder with a thermally insulating layer of a readily deformable material, the readily deformable material being selected from the group consisting of talcum powder and pyrophyllite powder, and (d) applying a pressure to the capsule and the readily deformable material in the pressure cylinder so as to cause the capsule and the deformable material therearound to be extruded together through the opening in the die.

2. A method according to claim 1 wherein the pressure cylinder includes a barrier closing the opening in the die, and wherein in step (d) a first pressure is applied to the capsule in the pressure chamber, the barrier is then removed from the opening in the die, and the capsule and the deformable material therearound are finally extruded together through the opening.

3. A method according to claim 2 wherein the barrier is a rupture disk and wherein the barrier is removed from the opening in the die by increasing the pressure in the pressure chamber beyond the first pressure such that the rupture disk ruptures.

4. A method according to claim 1 wherein the pressure cylinder is movable with respect to the die positioned therein, and wherein during step (d) the pressure cylinder is moved with respect to the die.

5. A method according to claim 2, in which the pressure applied to the capsule prior to removal of the barrier over the opening is an axial pressure exceeding 2 kilobar.

6. A method according to claim 1 or 2, in which the thermally insulating layer of readily deformable material has a thickness of between 10 and 40 mm.

7. A method according to claim 1 or 2 for the production of a tubular product, wherein the capsule in which the powder charge is enclosed is tubular in shape and the bore in the tubular capsule is lined with a thermally insulating, readily deformable material.

8. A method according to claim 7, in which a prepressed rod of the deformable material is located in the bore of the tubular capsule prior to embedding the rod and capsule in the insulating layer within the pressure cylinder.

9. A method according to claim 1 or 2, in which the area reduction during the extrusion in step (d) is greater than 3:1.

10. A method according to claim 1, including the step of adding a lubricating medium to the readily deformable material which surrounds the capsule in the pressure chamber, the lubricating medium being selected from the group consisting of polytetrafluoroethylene, boron nitride, graphite and molybdenum disulfide.

11. A method according to claim 1 or 2, including the step of applying a friction-reducing material to the inner surface of the pressure cylinder prior to placing the capsule therein in step (b).

* * * * *